US005307615A

United States Patent [19]

Walton et al.

[11] Patent Number: 5,307,615

[45] Date of Patent: May 3, 1994

[54] FLEXIBLE TENSION MEMBER

[75] Inventors: John M. Walton; Yeung C. Tong, both of Doncaster, England

[73] Assignee: Bridon Plc, South Yorkshire, England

[21] Appl. No.: 813,608

[22] Filed: Dec. 26, 1991

[30] Foreign Application Priority Data

Jan. 3, 1991 [GB] United Kingdom ..... 9100041

[51] Int. Cl.[5] ..... D02G 3/36

[52] U.S. Cl. ..... 57/214; 57/212; 57/213; 57/215; 57/218; 57/219

[58] Field of Search ..... 57/212, 213, 214, 215, 57/217, 218, 219

[56] References Cited

U.S. PATENT DOCUMENTS

| | | | |
|---|---|---|---|
| 3,686,855 | 8/1972 | Falcy et al. | 57/212 X |
| 3,778,993 | 12/1973 | Glushko et al. | 57/212 X |
| 3,956,877 | 5/1976 | Gilmore | 57/212 X |
| 4,454,708 | 6/1984 | Verreet | 57/215 |
| 5,173,982 | 12/1992 | Lovett et al. | 57/214 X |

FOREIGN PATENT DOCUMENTS

| | | | |
|---|---|---|---|
| 3940547 | 3/1991 | Fed. Rep. of Germany | 57/214 |
| 1197329 | 7/1970 | United Kingdom . | |
| 1334405 | 10/1973 | United Kingdom . | |
| 215208 | 7/1985 | United Kingdom . | |
| 2174118 | 10/1986 | United Kingdom . | |

*Primary Examiner*—Daniel P. Stodola
*Assistant Examiner*—William Stryjewski
*Attorney, Agent, or Firm*—Sandler Greenblum & Bernstein

[57] ABSTRACT

Flexible tension member includes a helical bundle of substantially identical elongate elements. Each element inside the bundle is in contact with six adjacent elements, and the lay length of the helical bundle is at least 30 times its diameter. Each element is a strand including wires extending helically around the axis of the strands and substantially all of the strands have a helical lay direction opposite to the helical lay direction of the bundle.

19 Claims, 2 Drawing Sheets

FLEXIBLE TENSION MEMBER

FIELD OF INVENTION

This invention relates to a flexible tension member, such as a tendon primarily intended for structural applications.

DISCLOSURE OF PRIOR ART

GB-A-2 152 089 discloses a flexible tension member comprising a helical bundle of identical rods spun together simultaneously, with a lay length 20 to 150 times (preferably 50 to 100 times) the bundle diameter, i.e. the diameter of the circle circumscribing the bundle.

GB-A-2 174 118 discloses a method of manufacturing such a tension member in long lengths and also discloses the application of the method to the manufacture of a rope consisting of 12 strands wound around an independent wire rope core.

BRIEF SUMMARY OF THE INVENTION

What is desired is a product which has a different structure from the products disclosed in the above-mentioned publications and which has advantages over those products.

The present invention provides a flexible tension member comprising a helical bundle of substantially identical elongate strands, the bundle comprising an outer layer having a plurality of strands, and an inner core having a plurality of strands, each of the strands in the inner core of the bundle being in contact with six adjacent strands, the lay length of the helical bundle being at least 30 times its diameter. Each strand comprises wires extending helically around the axis of the strand, and all or most of the strands having a helical lay direction opposite to the helical lay direction of the bundle.

The torsional moments generated by the helices of the strands which have a helical lay direction opposite to that of the bundle oppose the torsional amount generated by the helix of the bundle when under load.

A preferred embodiment of a flexible tension member according to the present invention comprises a bundle of steel wire strands arranged in a hexagonal array and spun together at a common helical lay (or pitch), so that the axis of each strand lies parallel to the axis of adjacent strands, i.e. the strands are in line contact with one another. The direction of lay of the bundle is opposite to that of the strands, so that the torsional moments generated by their respective helices oppose one another. The strands will typically be of simple construction such as $1\times7$ (6/1), i.e. seven identical wires, six of which are wound around a central one, although alternative strands having more or fewer wires could be used. The strands may be advantageously compacted to reduce the cross-sectional area that they occupy. The relative lay lengths of the strands and the bundle, respectively, should be selected to just bring the respective torsional moments into balance with one another in a quantitative sense.

In a compacted strand the outer wires have a flattened outer surface whose cross-section is an arc forming part of the circumscribing circle of the strand. In the bundle, compacted strands make approximate line contact with one another and can slide freely relative to one another in the longitudinal direction, facilitating flexing of the tension member. Furthermore, the use of compacted strands helps to ensure uniform geometry of the cross-section of the bundle at all points along its length, since the outer wires of adjacent strands do not interfere with one another.

The bending stiffness of the bundle increases with increasing lay length (i.e. the flexibility of the tension member decreases). Although the lay length may be as much as 150 times the bundle diameter, the preferred maximum is 75.

Conversely, decreasing the lay length of the bundle increases the torsional moment generated by the bundle helix under load. The minimum lay length is 30 times the bundle diameter.

As regards the strands, lay lengths of 12 to 18 times the strand diameter are commonly used for seven-wire strand. Strands of longer lay can be used if desired, as can strands with a lay length of less than 10 diameters.

A bundle of hexagonal cross-section (e.g. of 19, 37, 61, 91 or 127 strands) is easy to manufacture (by the method disclosed in GB-A-2 174 118) and could encourage vortex-shedding if used in situations subject to fluid loading (e.g. wind or water-currents). To provide a tension member with a smooth cylindrical exterior, the bundle may be sheathed or jacketed.

The sheating (or jacketing) operation may be carried out by pressure extruding directly over the hexagonal bundle to give a smooth circular external finish. Alternatively, elongate filler sections may be introduced prior to the extrusion process to present a circular profile on to which a jacket of constant annular thickness may be extruded, e.g. using a tubular die system. An external jacket may also be formed by helically wrapping the bundle with protective yarns or bands, e.g. self-adhesive tapes.

For additional protection of the strength member against corrosion, the voids within the bundle cross-section can be fully blocked with a water-blocking compound such as a wax or gel.

The invention will be described further, by way of example, with reference to the accompanying drawings.

DETAILED DESCRIPTION OF THE INVENTION

Figure 1:
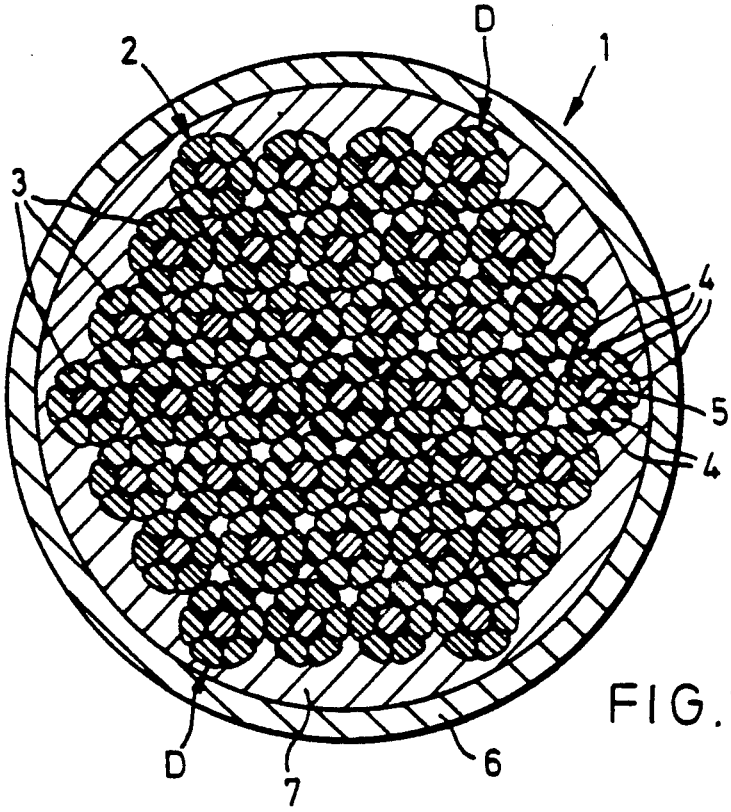
FIG. 1 is a cross sectional view of a first embodiment of a flexible tension member according to the present invention.

The flexible tension member illustrated in FIG. 1 is a cross-sectional view of a tension member 1 which comprises a hexagonal bundle (2) of 37 strands 3, each strand containing seven individual wires (4 and 5), six of which are outer wires (4), and the one remaining being a central wire (5). The bundle (1) of strands (3) is compacted together after stranding to give a trapezoidal shape to the outer wires 4. The bundle 2 is enclosed within a tubular jacket 6 and all the air spaces within the jacket (and not occupied by the strands 3) is filled with a water-blocking medium 7. Each of the strands 3 has a diameter of 12.7 mm yielding a bundle diameter D (across the corners) of about 90 mm. For achieving torsional equilibrium under load, the individual wires (4 and 5) are first stranded together with a right-hand lay direction. Then the strands 3 are assembled together in the bundle 2 with a left-hand lay. The appropriate lay lengths for achieving complete torsional balance (under load) in the finished product may be determined either by experiment or calculation, but for typical strand lays in the above example, the bundle pitch (lay-length) may approximately 50 times the bundle diameter.

Figure 2:
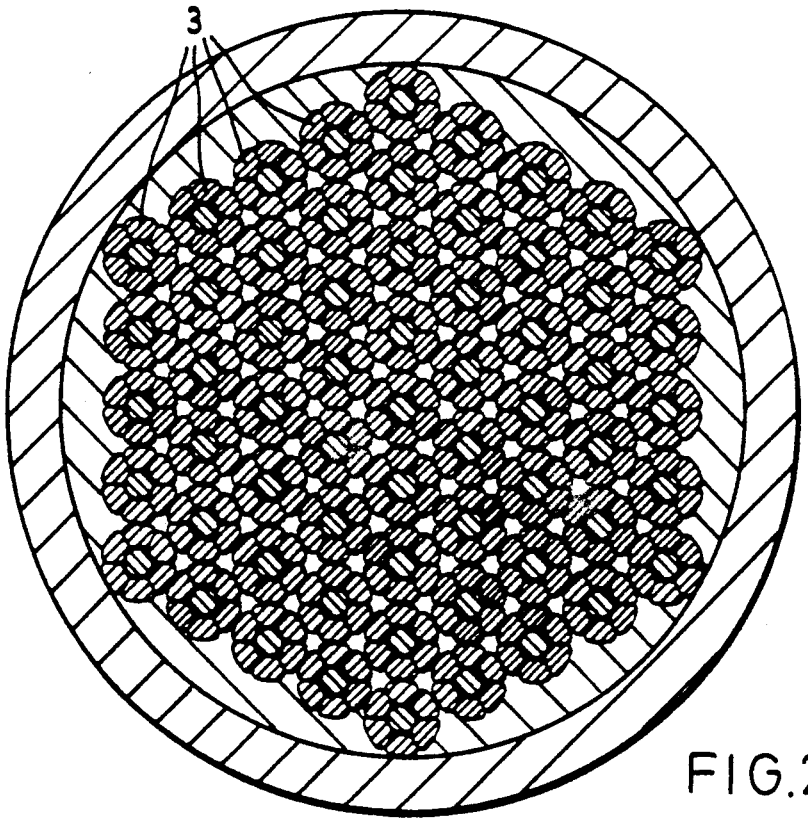
FIG. 2 is a cross-sectional view of a second embodiment of a flexible tension member according to the present invention.

A further example is illustrated in FIG. 2, in which 61 strands 3 of similar size are spun together to give a bundle diameter of about 115 mm.

Figure 3:
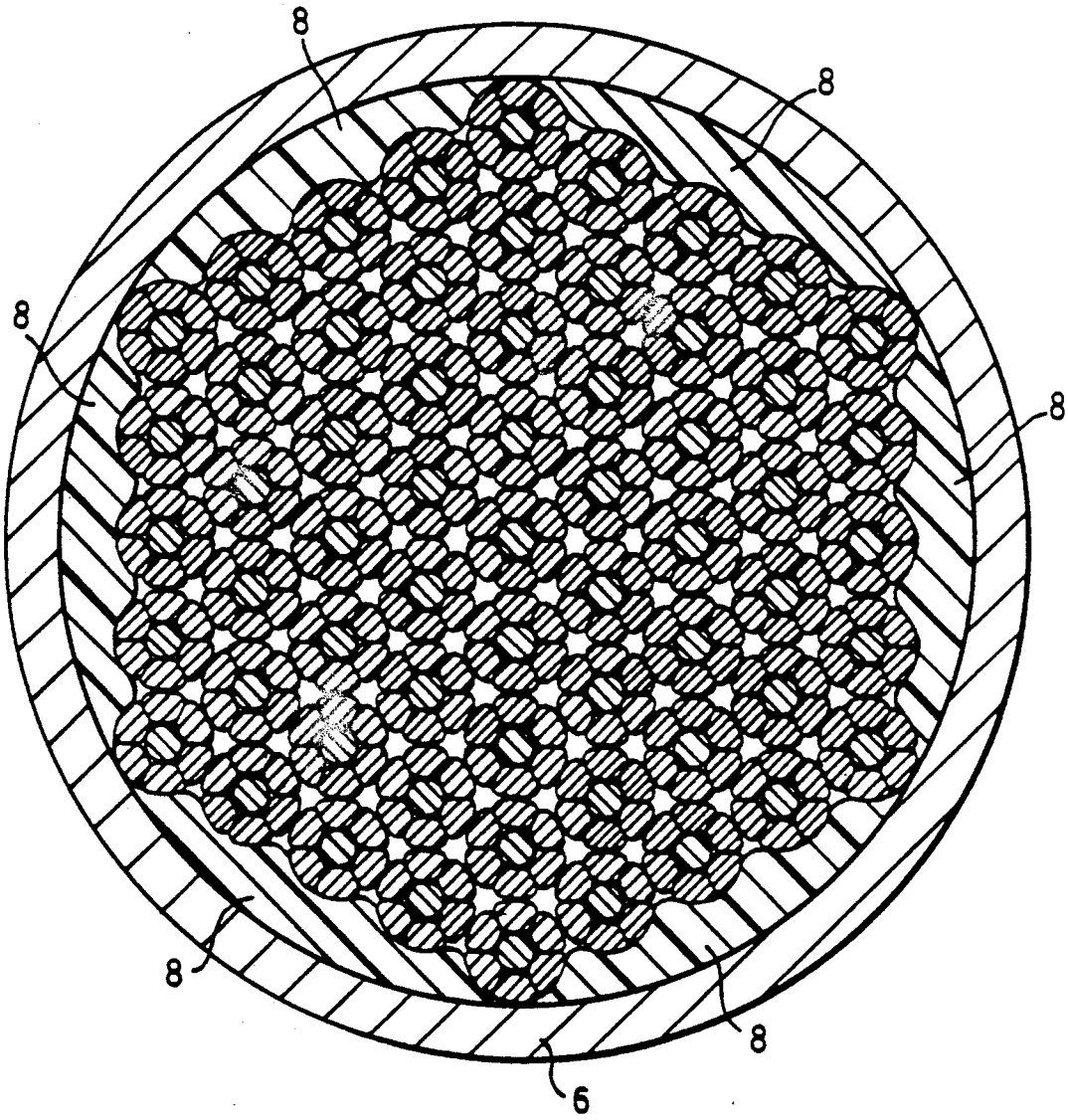
FIG. 3 is a cross-sectional view of a third embodiment of a flexible tension member according to the present invention.

FIG. 3 illustrates a tension member comprising 61 strands (3) each having a diameter of 16 mm, yielding a bundle diameter of about 145 mm. In this case the six spaces between the jacket and the flats of the hexagonal bundle are occupied by elongate filler strips 8, e.g. of plastics or (soft) metal. The filler strips 8 have a pressure-bearing function and may be continuous or discontinuous. They may further comprise anodic material (e.g. zinc), in order to provide cathodic protection to the steel wires 4,5.

The flexible tension members described above have advantages over a bundle or rods. The balancing of torques avoids loss of geometry during installation and avoids the application of torsional loads to end-fixings. A member of a given size can be made with fewer components, and larger sizes are simpler to manufacture. Higher tensile strength (e.g. 1800 MPa) can be achieved. The member is more flexible, i.e. it has lower bending stiffness, while having high axial stiffness. Furthermore, on initial loading there is virtually no non-elastic stretching, so that prestressing is not required.

What is claimed is:

1. A flexible tension member comprising a helical bundle comprising a plurality of substantially identical strands, said bundle comprising an outer layer having a plurality of strands, and an inner core having a plurality of strands, each of said strands in said inner core being in contact with six adjacent strands, said bundle having a lay length of at least 30 times a diameter of said bundle, each of said strands comprising wires extending helically around an axis thereof, substantially all of said strands having a helical lay direction opposite to the helical lay direction of said bundle.

2. The flexible tension member according to claim 1, wherein said strands each comprise outer wires having a flattened outer surface, and having an arcuate cross-section forming a portion of a circle circumscribing said strand.

3. The flexible tension member according to claim 1, wherein each strand comprises seven wires.

4. The flexible tension member according to claim 1, wherein said bundle has a hexagonal cross-section.

5. The flexible tension member according to claim 4, wherein said bundle contains a number of strands comprising at least one member selected from the group consisting of 19, 37, 61, 91, and 127.

6. The flexible tension member according to claim 4, further comprising a plurality of elongate filler elements extending along respective sides of said bundle, and together with said bundle, making up a substantially circular cross-sectional shape.

7. The flexible tension member according to claim 1, wherein said lay length of said helical bundle is at most 75 times its diameter.

8. The flexible tension member according to claim 1, wherein torsional moments generated by said helix of said bundle and by said helices of said strands, when said flexible tension member is under tension, are substantially balanced.

9. A flexible tension member comprising a bundle arranged in a primary helix, said bundle comprising a plurality of substantially identical elongate strands, said bundle comprising an outer layer having a plurality of strands, and an inner core having a plurality of strands, each of said strands of said inner core being in contact with six adjacent strands, said strands comprising wires arranged in a secondary helix around a longitudinal axis of each of said strands, and said bundle having a lay length of at least 30 times its diameter; and wherein said strands have a helical lay direction opposite to the helical lay direction of said bundle, and wherein a torsional moment generated by said primary helix substantially balances a torsional moment generated by said secondary helices, when said flexible tension member is under tension.

10. The flexible tension member according to claim 9, wherein said strands each comprise outer wires having a flattened outer surface, and having an arcuate cross-section forming a portion of a circle circumscribing said strand.

11. The flexible tension member according to claim 9, wherein which each strand comprises seven wires.

12. The flexible tension member according to claim 9, wherein said bundle has a hexagonal cross-section.

13. The flexible tension member according to claim 12, wherein said bundle contains a number of strands comprising at least one member selected from the group consisting of 19, 37, 61, 91, and 127.

14. The flexible tension member according to claim 12, further comprising a plurality of elongate filler elements extending along respective sides of said bundle, and together with said bundle, making up a substantially circular cross-sectional shape.

15. The flexible tension member according to claim 9, wherein said lay length of said helical bundle is at most 75 times its diameter.

16. The flexible tension member according to claim 9, further comprising, within said bundle, at least one member selected from a wax and a gel.

17. The flexible tension member according to claim 9, further comprising a tubular jacket surrounding said bundle.

18. The flexible tension member according to claim 9, having a tensile strength of at least 1800 MPa.

19. The flexible tension member according to claim 9, wherein said tension member does not require prestressing, and exhibits substantially no inelastic stretching.

* * * * *